US007635126B2

(12) United States Patent
Walther

(10) Patent No.: US 7,635,126 B2
(45) Date of Patent: Dec. 22, 2009

(54) METHOD AND DEVICE FOR GATHERING SHEETS WITH CONTINUOUS AIR CUSHION SUPPORT

(75) Inventor: Andreas Walther, Stadthagen (DE)

(73) Assignee: Kolbus GmbH & Co. KG, Rahden (DE)

( * ) Notice: Subject to any disclaimer, the term of this patent is extended or adjusted under 35 U.S.C. 154(b) by 494 days.

(21) Appl. No.: 11/492,266

(22) Filed: Jul. 25, 2006

(65) Prior Publication Data

US 2007/0023993 A1 Feb. 1, 2007

(30) Foreign Application Priority Data

Jul. 28, 2005 (DE) ..... 10 2005 035 331

(51) Int. Cl.
*B65H 3/14* (2006.01)

(52) U.S. Cl. ..... 271/98; 271/12; 271/97

(58) Field of Classification Search ..... 271/12, 271/97, 98

See application file for complete search history.

(56) References Cited

U.S. PATENT DOCUMENTS 5,092,578 A * 3/1992 Bergmeier et al. ..... 271/97
6,022,014 A * 2/2000 Rathert et al. ..... 271/11
6,206,361 B1 * 3/2001 Geldmeier ..... 271/9.12

FOREIGN PATENT DOCUMENTS

DE 196 16 047 A1 10/1997

* cited by examiner

*Primary Examiner*—Patrick H Mackey
*Assistant Examiner*—Gerald W McClain
(74) *Attorney, Agent, or Firm*—Alix, Yale & Ristas, LLP

(57) ABSTRACT

During the gathering process, an individual signature is respectively withdrawn from several collections of identical signatures, wherein the various decollated signatures are delivered to a collecting conveyor in order to form stacks. In this case, the sheets need to be reliably and carefully decollated. The invention proposes that the sheets (3) of a collection are made available in the form of a stack (4), wherein the stack (4) is essentially supported by an air cushion (LP), that the bottom sheet (3) is at least regionally lifted off the stack (4) with the aid of a separating tool (30), that the air cushion (LP) is produced between the bottom sheet (3) and the residual stack (4), and that the sheet (3) is delivered to the collecting conveyor (10). The lifted-off sheet is completely separated from the stack by the air cushion such that the sheet can be transported out of the magazine with absolutely no friction relative to the stack (4) situated above the separated sheet.

18 Claims, 3 Drawing Sheets

METHOD AND DEVICE FOR GATHERING SHEETS WITH CONTINUOUS AIR CUSHION SUPPORT

BACKGROUND OF THE INVENTION

The invention pertains to a method and a device for gathering printed sheets, particularly signatures and/or individual sheets.

During the gathering process in a book binding system, an individual signature is respectively withdrawn from several collections of identical signatures, wherein the various decollated signatures are delivered to a collecting conveyor in order to form stacks.

Known gathering machines feature feeder stations that are arranged in a row and respectively consist of a magazine for accommodating a signature stack, a withdrawal drum with a gripper mechanism for taking hold of and withdrawing the respective bottom signature that is tilted away from the signature stack, and an intermediate support for temporarily depositing the decollated signature. The collecting conveyor features a collecting channel that is oriented perpendicular to the signature withdrawal direction, wherein pushers of a transport chain moving in said collecting channel strip the decollated signatures off the individual intermediate supports and gather the signatures into a book block on the collecting channel. Such a gathering machine that operates with a change of direction is described in DE 14 86 744 B. This machine furthermore features reciprocating intermediate tables for pre-accelerating the decollated signatures for the transport by the pushers of the collecting conveyor.

A gathering machine with feed stations according to the longitudinal withdrawal principle is known from DE 196 16 047 A1, wherein this gathering machine comprises a conveyor belt that carries a signature stack in a magazine such that a region of the folded edge remains exposed and respectively advances the bottom signature in a correspondingly cyclic fashion, as well as a withdrawal conveyor system that serves for receiving and additionally transporting the advanced signatures and is composed of acceleration rollers. A clamping conveyor consisting of an upper and a lower conveyor belt is arranged downstream of the withdrawal conveyor system and inclined toward the collecting conveyor, wherein this clamping conveyor deposits the decollated signatures on the stack being formed with a synchronous transport movement upstream of a pusher of the collecting conveyor. The signatures decollated by the feeder stations are delivered to the collecting conveyor without a change of direction.

One disadvantage of known decollating devices can be seen in that the weight of the signature stack rests on the respective bottom signature such that corresponding frictional forces are generated between the bottom signature to be withdrawn and the following signature of the stack. This can result in markings on sensitive surfaces. One also has to accept the risk of dragging along the following signature. Stack lifters and blast air nozzles are used for minimizing these frictional forces, wherein an air cushion is produced between the bottom signature and the following signature with the aid of blast air. However, this is frequently only possible regionally because the introduced blast air escapes from the stack in accordance with the principle of least resistance.

SUMMARY OF THE INVENTION

The present invention is based on the objective of developing a method and a device for gathering printed sheets, particularly signatures and/or individual sheets, to achieve a reliable and careful decollation of the sheets.

The sheet stack is supported in the magazine by an air cushion, wherein the air cushion is immediately produced between the bottom sheet and the residual stack when the respective bottom sheet is lifted off, without the air cushion collapsing. The stack is also supported at a constant level by the air cushion when the bottom sheet is lifted off, wherein the lifted-off sheet is transported away from the stack within the air cushion and ultimately separated entirely from the stack by the air cushion such that a frictionless withdrawal is achieved.

The air cushion is preferably produced by a blast air current that is introduced laterally underneath the stack. It is practical if the bottom sheet is lifted off the stack in the region of the blast air current. The air cushion is produced as soon as the blast air current reaches the area between the sheet that is regionally lifted off and the residual stack, wherein the sheet is instantaneously and completely separated from the stack. According to one preferred embodiment of the method, the sheet that is completely separated from the stack is pressed onto a supporting surface in the form of a transport means by the pressure of the air cushion such that an acceleration to a high withdrawal transport speed can be realized with little slip.

A certain height of the stack underside is preferably maintained by ventilating the air cushion. The ventilation and the air quantity supplied to the air cushion make it possible to realize a simple pressure control for the air cushion. The stack is preferably supported by the air cushion such that it is inclined by a certain angle, wherein one outer side of the stack is supported on a wall in a weight-reducing fashion.

The sheet is preferably transported away parallel to the transport direction of the collecting conveyor and delivered to the collecting conveyor with an essentially synchronous transport speed. The sheets decollated from the magazine are delivered to the collecting conveyor without a change of direction.

BRIEF DESCRIPTION OF THE DRAWINGS

Characteristics of the present invention are described in greater detail below with reference to one preferred embodiment of the invention that is illustrated in the figures. The individual figures show.

DESCRIPTION OF THE PREFERRED EMBODIMENT

Figure 1:
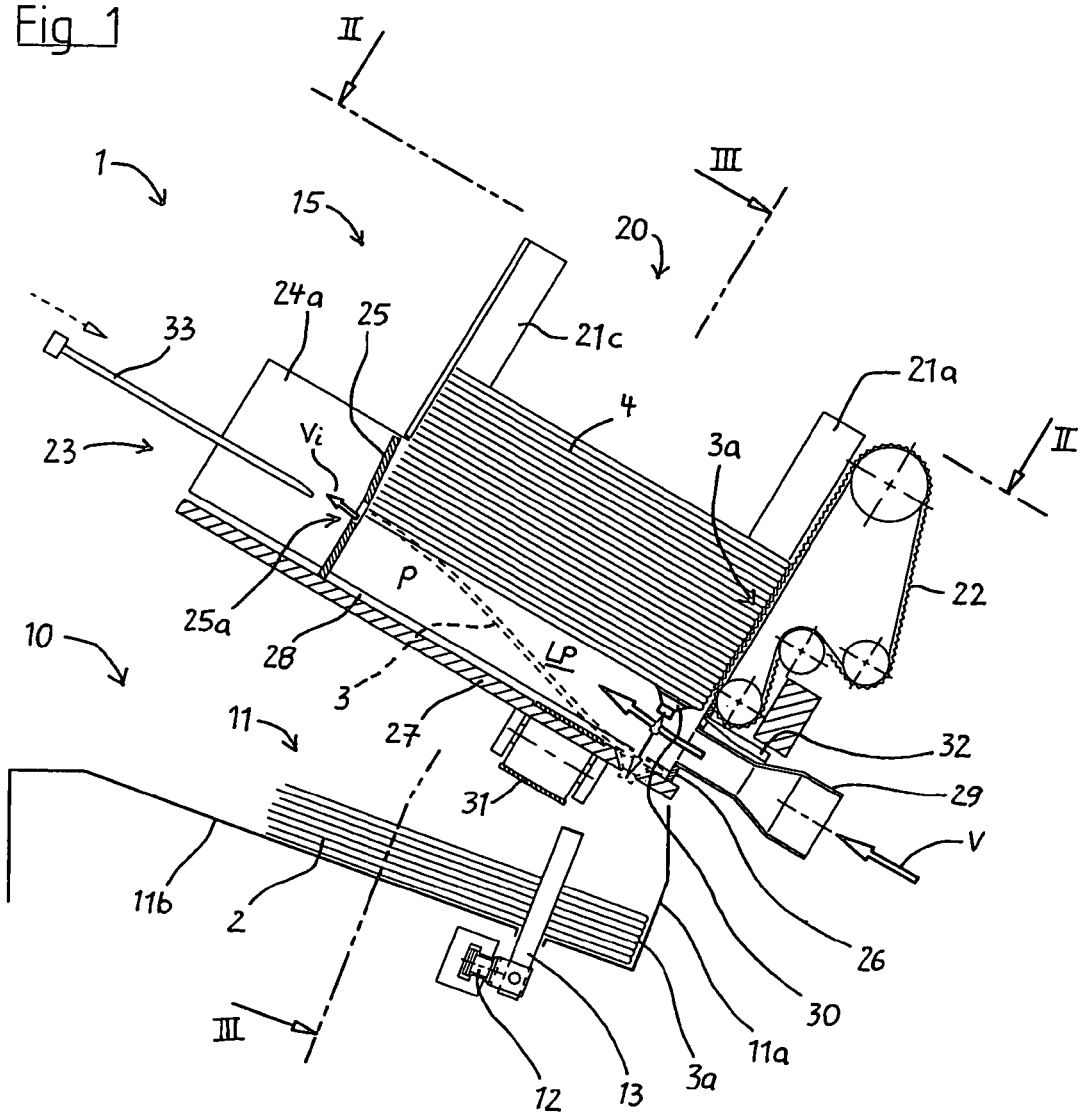
FIG. 1, a sectional representation of a gathering machine with a feeder station according to the invention.
Figure 2:
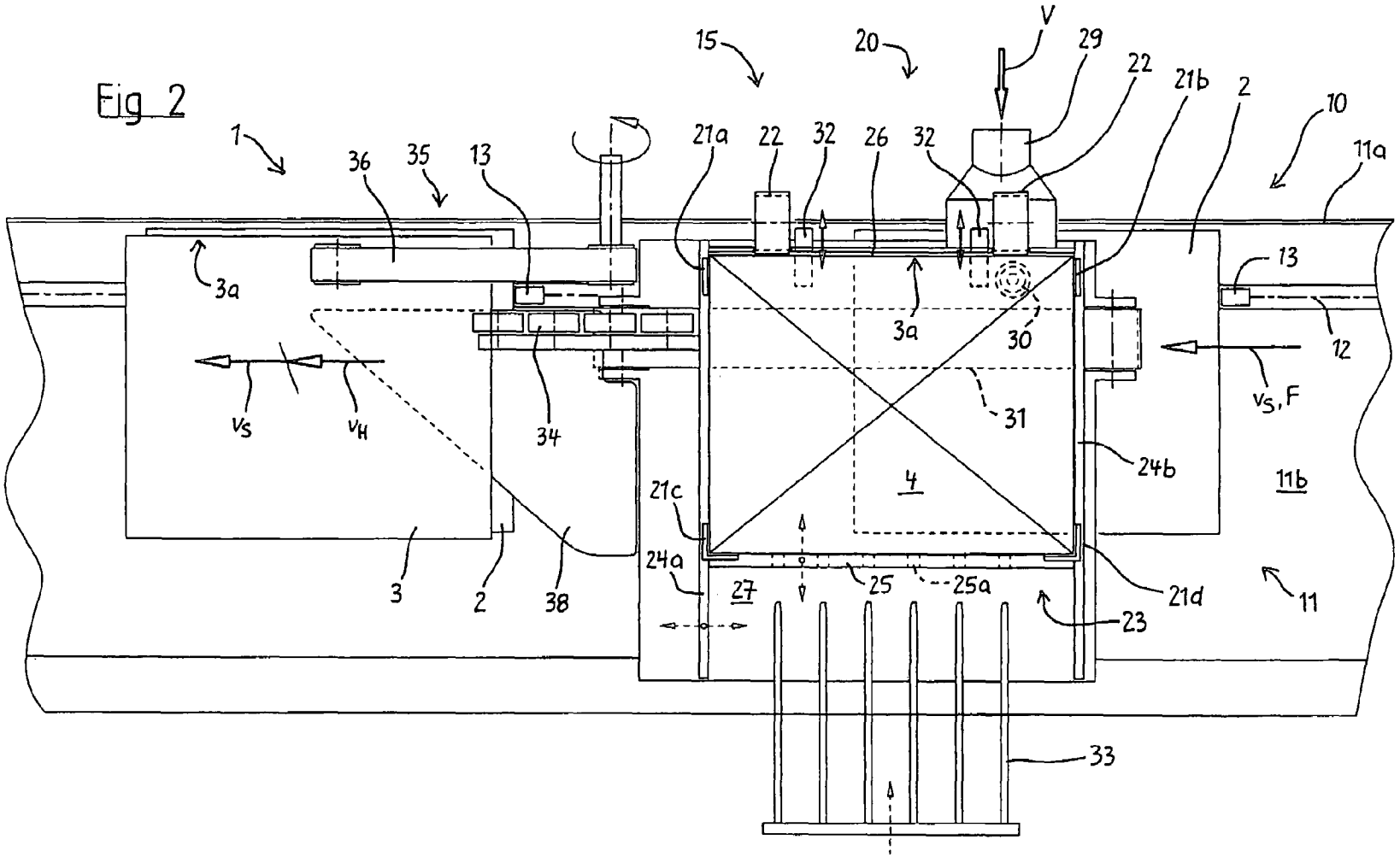
FIG. 2, a top view of the gathering machine along the line of section II-II in FIG. 1, and FIG. 3, a section through the gathering machine along the line of section III-III in FIG. 1.
Figure 3:
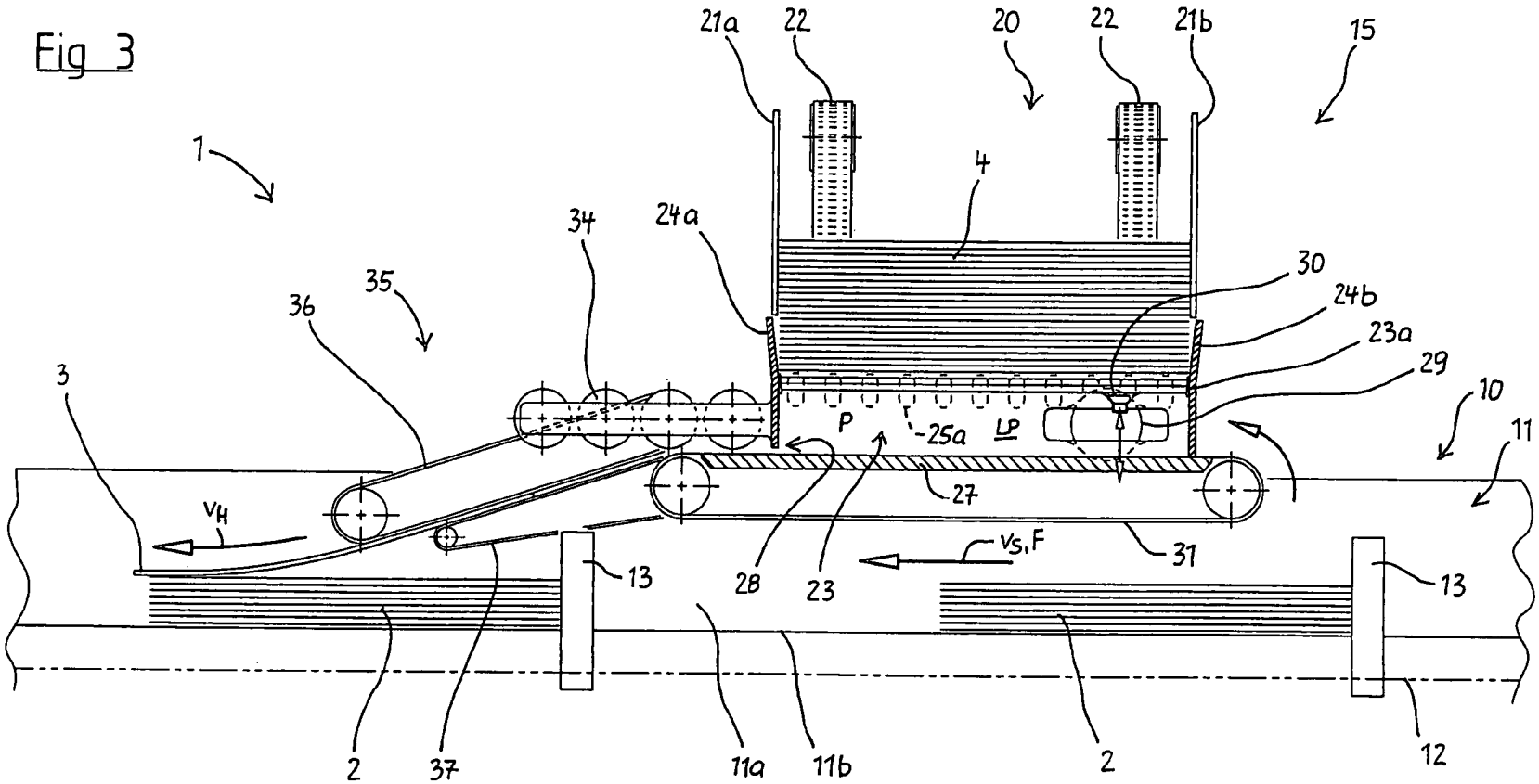

The figures show a gathering machine that is identified as a whole by the reference symbol 1, comprising a collecting conveyor 10 and several feeder stations 15 that are arranged in a row above the collecting conveyor, wherein only a single feeder station is illustrated in the figures. In each of these feeder stations 15, a single signature 3 is respectively withdrawn from a source stack 4 of identical signatures and delivered to the collecting conveyor 10 in order to form collated stacks. The collecting conveyor 10 is formed by a transport channel 11 with an inclined channel bottom 11*b* and a channel wall 11*a* that extends perpendicular thereto, as well as a transport chain 12 that is driven in the (collecting) transport direction F with a continuous transport speed vS and includes pushers 13 that are uniformly spaced apart from one another and advance the book blocks 2 being formed in the transport channel 11, wherein the spine 3*a* of the book block or the signature 3 adjoins the vertical channels wall 11*a*.

A feeder station 15 has a magazine 20 with lateral magazine boundaries 21*a* through *d* and a lower section in the form of a basin 23, in which an air cushion LP for supporting the signature stack 4 is produced by introducing a blast air current V. The basin 23 is formed by a front and a rear side wall 24*a* and *b*, a left and a right side wall 25 and 26 as well as a bottom 27.

The magazine 20 with the basin 23 is inclined by a certain angle such that the signatures in the signature stack 4 adjoin the right side wall 26 with their spine 3*a*. The right side wall 26 has associated conveyor belts 22 with profiled support surfaces that extend as far as the upper magazine region and not only ensure that the weight is additionally reduced, but simultaneously serve for replenishing the signature stack 4.

The blast air current V is introduced into the basin 23 by a blast air nozzle 29 that is arranged in the right side wall 26 and connected to a blast air source that is not illustrated in detail, wherein the blast air current predominantly escapes through ventilation openings 25*a* in the opposite side wall 25 when a signature stack 4 is supported. This creates an air cushion LP with a relative atmospheric pressure P that is able to support the signature stack 4 in accordance with the hovercraft principle.

In this case, the supporting level lies in the region of the ventilation openings 25*a* that make it possible to realize a simple pressure control: the signature stack 4 supported on the air cushion LP partially covers the ventilation openings 25*a* such that their effective cross section for the discharge of the partial blast air currents Vi ventilating the air cushion is reduced. As the weight of the stack decreases, the air cushion LP raises the signature stack 4 such that the cross section is increased and the pressure of the air cushion LP drops until the pressure P is once again in equilibrium with the weight of the signature stack 4 to be supported. Vice versa-for example, when the weight of the stack increases due to the replenishing with partial stacks-the effective cross section is reduced such that an air cushion LP with a correspondingly higher pressure P is produced.

In order to minimize blast air leaks, the side walls 24*a, b*, 25 and 26 are tightly adjusted to the respective signature format. Sealing lips 23 *a* are provided in the region of the supporting level in order to compensate format size tolerances as well as signatures that do not lie exactly on top of one another within the signature stack 4.

The separating device for decollating the respective bottom signature 3 from the magazine 20 features at least one suction element 30 that engages the signature 3 in the rear edge region near the spine in the corresponding cycle and lifts the signature 3 off the signature stack 4 toward the bottom in the region of the blast air nozzle 29. This causes the blast air current V to reach the intermediate space between the lifted-off signature and the following signature such the air cushion LP is produced in the intermediate space and the bottom signature 3 is instantaneously and completely separated from the signature stack 4. Stack lifters 32 in the right side wall 26 are moved in the corresponding cycle in order to support the residual stack and to ensure that the signature stack is still held at the constant supporting level.

The signature 3 that is completely separated from the signature stack 4 is flatly pressed against the bottom 27 of the basin 23 by the pressure P of the air cushion LP and, in particular, onto a continuously driven conveyor belt 31 that extends parallel to the collecting conveyor 10 in the bottom 27 such that an acceleration to a high withdrawal transport speed vH that approximately corresponds to the (collecting) transport speed vS can be achieved with little slip. The signature 3 is withdrawn without any friction referred to the signature stack 4 through an outlet gap 28 in the front side wall 24*a*, wherein the additional transport outside the magazine 20 is ensured by pressing rollers 34 that act upon the conveyor belt 31 extending out of the magazine 20.

The withdrawn signature 3 is ultimately transported to the collecting conveyor 10 by a clamping conveyor 35 that is inclined toward the collecting conveyor 10 and formed by a lower and an upper conveyor belt 36, 37 as well as a supporting plate 38, wherein said signature is then delivered in front of the respective pusher 13 with the transport speed vH. The decollated signature 3 consequently is transported out of the magazine 20 without a change of direction and delivered to the collecting conveyor 10 with a nearly synchronous transport speed vH in order to form stacks.

Supporting rods 33 are utilized for initially filling the magazine 20, wherein these supporting rods can be inserted into the magazine 20 at the height of the supporting level through the ventilation openings 25*a* and thusly form a rake-shaped supporting surface.

The invention claimed is:

1. In a method for gathering printed sheets, wherein one individual sheet is withdrawn from each of several sources, each source composed of identical sheets; and the withdrawn sheets are delivered to a collecting conveyor in order to form collated stacks;

the improvement comprising that:

each source of the sheets is stack, supported by air pressure (P) of an air cushion (LP) above a basin floor, each stack having a bottom sheet and residual stack above the bottom sheet;

while the air cushion continuously supports the entire source stack, at least a region of the bottom sheet of the source stack is lifted off the residual stack with a separating tool;

as the bottom sheet is lifted off the residual stack the air cushion (LP) is produced between the bottom sheet and the entire residual stack, thereby completely separating the bottom sheet from the residual stack to drop onto the basin floor while supporting an entire remaining source stack having a following bottom sheet and remaining residual stack above the basin floor; and the separated bottom sheet is delivered as said withdrawn sheet to the collecting conveyor.

2. The method according to claim 1, wherein the air cushion (LP) is produced by a blast air current (V) that is introduced laterally underneath the source stack.

3. The method according to claim 2, wherein the bottom sheet is lifted off the source stack where the blast air current (V) is introduced and is then completely separated from the source stack by the blast air current (V).

4. The method according to claim 3, wherein the bottom sheet that is completely separated from the source stack is pressed against a supporting surface of a transporter by the pressure (P) of the air cushion (LP).

5. The method according to claim 1, wherein a predetermined elevation of the source stack on the air cushion is maintained by ventilating the air cushion (LP).

6. The method according to claim 1, wherein the source stack is supported by the air cushion (LP) at a certain angle, with one peripheral side of the source stack supported on a weight-bearing wall.

7. The method according to claim 1, wherein the collecting conveyor travels in a transport direction (F) at a transport speed (vH), and the withdrawn sheet is transported parallel to the transport direction (F) of the collecting conveyor and delivered to the collecting conveyor with a synchronous transport speed (vH).

8. In a device for gathering printed sheets having, several feeder devices each containing a source of identical sheets to be withdrawn individually, and a collecting conveyor for gathered stacks of collated sheets, including a collecting channel and a transport chain with pushers that travel in a transport direction (F), to which the withdrawn source sheets are delivered in order to form stacks, the improvement in each feeder device comprising:

a magazine for accommodating a source stack of identical sheets, each source stack having a bottom sheet and residual stack above the bottom sheet;

a basin-shaped lower section of the magazine having side walls and a floor, said lower section connected to a blast air source having sufficient air flow to produce an air cushion (LP) continuously supporting the entire source stack above the floor;

a separating device engageable with at least a region of the bottom sheet for lifting the bottom sheet off the source stack;

whereby air flow over the lifted bottom sheet separates the bottom sheet from the residual stack and drops the bottom sheet toward the basin floor while the entire residual stack remains above the floor; and a transport device for transferring the bottom sheet separated from the source stack by the air cushion (LP), from the floor to the collecting conveyor.

9. The device according to claim 8, wherein the blast air source includes a blast air nozzle in a side wall of the lower section.

10. The device according to claim 8, wherein the air blast source produces an air cushion (LP) continuously supporting the source stack above the floor at a predefined supporting level in the lower section, and ventilation bores are arranged in at least one side wall of the lower section at the stack supporting level.

11. The device according to claim 8, wherein the separating device comprises at least one suction element.

12. The device according to claim 11, wherein the suction element is arranged adjacent to the blast air nozzle.

13. The device according to claim 8, comprising stack lifters that have one position that support the stack in a stack edge region and can be moved to a second, non-supporting position when the bottom sheet is lifted off.

14. The device according to claim 8, wherein the transport device comprises a conveyor belt that extends across the basin floor and onto which the bottom sheet separated from the stack is pressed by the air cushion (LP).

15. The device according to claim 8, comprising an outlet gap in the lower section through which the separated sheet is transported out of the magazine.

16. The device according to claim 8, wherein the transport device is essentially oriented parallel to the transport direction (F) of the collecting conveyor.

17. The device according to claim 8, wherein the magazine with the basin-shaped lower section is arranged with the side walls and floor at an incline to horizontal.

18. The device according to claim 17, comprising conveyor belts in the side wall of the magazine that assist in supporting the inclined stack, wherein said conveyor belts also replenish the stack with sheets.

* * * * *